United States Patent [19]

Elston et al.

[11] 4,289,580

[45] Sep. 15, 1981

[54] HEAT SEAL FIBROUS WEB AND METHOD OF ITS MANUFACTURE

[75] Inventors: Colin Elston, Windsor, Conn.; Herbert A. Hoffman; H. Joseph Murphy, both of Longmeadow, Mass.

[73] Assignee: The Dexter Corporation, Windsor Locks, Conn.

[21] Appl. No.: 93,441

[22] Filed: Nov. 13, 1979

[51] Int. Cl.[3] ..... D21H 5/02

[52] U.S. Cl. ..... 162/109; 162/115; 162/129; 162/146; 162/208

[58] Field of Search ..... 162/115, 116, 146, 129, 162/208, 210, 109; 428/171, 286, 288

[56] References Cited

U.S. PATENT DOCUMENTS

| | | | |
|---|---|---|---|
| 995,602 | 9/1909 | Howes | 162/115 |
| 2,414,833 | 1/1947 | Osborne | 162/129 |
| 3,067,087 | 12/1962 | Gorski et al. | 162/157 R |
| 3,350,260 | 10/1967 | Johnson | 162/116 |

*Primary Examiner*—Peter Chin

*Attorney, Agent, or Firm*—Prutzman, Kalb, Chilton & Alix

[57] ABSTRACT

Improved infusion web material for tea bags and the like is provided by using synthetic pulp in the heat seal phase and forming therein an array of a large number of small discrete craters. These craters, which exhibit an average planar area of at least about $1\times10^{-3}$ square centimeters, are formed prior to drying the initially formed multi-phase material by directing a low impact mist-like liquid spray onto the heat seal phase. The droplets from the spray displace the fibers to form the shallow craters and, at times, expose portions of the underlying non-heat seal fiber phase. The small craters are present throughout the heat seal phase at a concentration of at least about 40 per square centimeter and occupy about 10–75 percent of the total exposed surface area of the heat seal fiber phase of the material. The web also is treated with a surfactant.

17 Claims, 3 Drawing Figures

HEAT SEAL FIBROUS WEB AND METHOD OF ITS MANUFACTURE

TECHNICAL FIELD

The present invention relates generally to water laid infusion web materials and more particularly is concerned with a new and improved multi-phase heat sealable fibrous web having particular application as infusion packaging material, such as for tea bags and the like. The invention also relates to the process of manufacturing such fibrous web materials.

BACKGROUND ART

Heretofore, heat sealable tea bag papers have comprised both single phase and multi-phase sheet material. Both materials have included non-heat seal fibers such as cellulosic fibers in combination with heat seal fibers. The particular heat seal fibers used have included thermoplastic fibers, such as the fibers of a copolymer of polyvinyl acetate, commonly referred to as "vinyon," and polyolefin fibers such as fibers of polyethylene and polypropylene. These synthetic heat seal fibers are typically smooth rod-like fibrous materials exhibiting a low specific surface area. They form a highly porous and open structural arrangement which, despite their hydrophobic character, permit adequate liquid permeability and transmission of both hot water and tea liquor through the sheet material during the normal brewing process. During manufacture the sheet material is dried by a conventional heat treatment resulting in a slight contraction of the heat seal thermoplastic fibers that maintains and enhances the desired open distribution of the heat seal particles throughout the sealing phase of the web.

In recent years, fibrillar materials formed from polyolefins and similar polymers have been introduced in the paper industry. These materials, commonly referred to as "synthetic pulps", exhibit certain processing advantages over the smooth rod-like synthetic fibers used heretofore. The synthetic pulps exhibit a fibrilliform morphology and resultant higher specific surface area. Additionally, they are more readily dispersible in water without the need for additional surface active agents and, although hydrophobic in nature, they do not dewater as rapidly as conventional synthetic fibers and therefore avoid plugging problems in lines, pumps, etc., within the paper-making machine. Further, these synthetic particles do not exhibit the tendency to "float out" in chests and holding tanks used in the typical paper-making process. For these reasons the synthetic pulps exhibit a potential for use as the heat seal component of infusion package materials, particularly since they provide substantially improved wet seal strength under end use conditions, that is, improved wet seal strength in a hot aqueous liquid environment and improved resistance to seal delamination under boiling and steaming test conditions.

Despite the apparent advantages evident in the use of synthetic pulp for heat seal infusion paper application, it has been found that such material exhibits a significant disadvantage with respect to its infusion properties and its wettability. This disadvantage relates directly to its usefulness in the paper-making process, that it, its fibrilliform structure and high specific surface area. When the synthetic pulp is heat treated, as in the conventional drying operation, it tends to soften and flow, typically forming a film, albeit discontinuous, particularly in the heat seal phase of a multi-phase sheet material. Unlike the highly porous and open web structure formed by the larger and smoother synthetic fibers, the high surface area pulp with its lower density, smaller particle size and more numerous particles results in a closed, low permeability structure. In addition, the hydrophobic nature of the basic polymer inhibits water permeability and any surfactant added to the synthetic pulp is neutralized during the drying process. The result is that certain areas of the web surface are rendered water impermeable substantially retarding or inhibiting infusion and reducing the water permeability and wettability of the material. In use, the non-wetted or partially wetted areas of the web material are easily observed as opaque areas on the sheet while the thoroughly wetted areas exhibit a transparent appearance. The reduced wettability of the web material coupled with its mottled opaque appearance influences the aesthetic attractiveness of the product under end use conditions and, therefore, its acceptability by the consumer.

DISCLOSURE OF INVENTION

Accordingly, the present invention provides a new and improved heat seal fibrous web material utilizing synthetic pulp as the heat seal fibrous component yet at the same time obviates the infusion and wettability deficiencies noted hereinbefore with respect to the use of such material. More specifically there is provided a heat sealable fibrous web having a disruptively modified heat seal phase having a larger total infusion area with an attendant enhancement in liquid permeability.

Additionally the present invention provides a new and improved process for the manufacture of heat seal infusion web materials having excellent infusion characteristics and improved strength characteristics through the utilization of synthetic pulp and the incorporation within the process of a technique for overcoming the infusion and wettability deficiencies observed heretofore with respect to the use of synthetic pulp material. This process involves the modification of essentially only the heat seal phase of a multiphase heat seal infusion web material to facilitate improved infusion characteristics despite the greater covering power of the high surface area hydrophobic synthetic pulp material. This is accomplished by disruptively modifying the heat seal material's heat generated film, thereby increasing the open surface area of the heat seal phase to provide a larger total infusion area and greater water permeability. This process includes the step of forming a random array of small high-infusion areas having a reduced synthetic pulp content, with some areas being essentially free of heat seal synthetic fibers so as to fully expose the underlying non-heat seal phase of the multiphase material. These small high-infusion areas can be formed in a simple and facile manner at relatively low cost with no substantial decrease in the production rate of the multi-phase heat seal material yet with improved seal strength under end use conditions by a simple low impact mist-like spray and subsequent treatment with a surfactant.

The heat seal phase of a multi-phase infusion web material is provided with a random array of a large number of small discrete craters by displacement of particles in the heat seal phase to form the craters. These craters, which expose portions of the underlying non-heat seal fiber phase, exhibit an average planar area of at least about $1\times10^{-3}$ square centimeters and are formed prior to drying the initially formed multi-phase web material. The small craters are present throughout the heat seal phase at a concentration of at least about 40 per square centimeter and occupy about 10–75 percent of the total exposed surface area of the heat seal fiber phase of the material.

BRIEF DESCRIPTION OF DRAWINGS

A better understanding of the invention will be obtained from the following detail description of the several steps of the process together with the relation of one or more of such steps with respect to each of the others and the article processing the features, properties and relation of elements exemplified in the following detailed description. In the drawing.

BEST MODE FOR CARRYING OUT THE INVENTION

As mentioned hereinbefore, the present invention provides a technique for improving the infusion characteristics of a heat seal fibrous web material suited for use in tea bags or the like. This is accomplished by, in effect, enhancing the water permeable surface area of the heat seal phase of that material. In the preferred embodiment the enhancement is achieved primarily by physical disruption of the heat seal phase and secondarily through chemical treatment of the fibrous web material. It is this combination of physical and chemical treatments which provides the enhanced infusion characteristics found necessary when using larger surface area heat seal particles of low density and smaller particle size, such as the fibrous particles in commercially available synthetic pulp.

Figure 1:
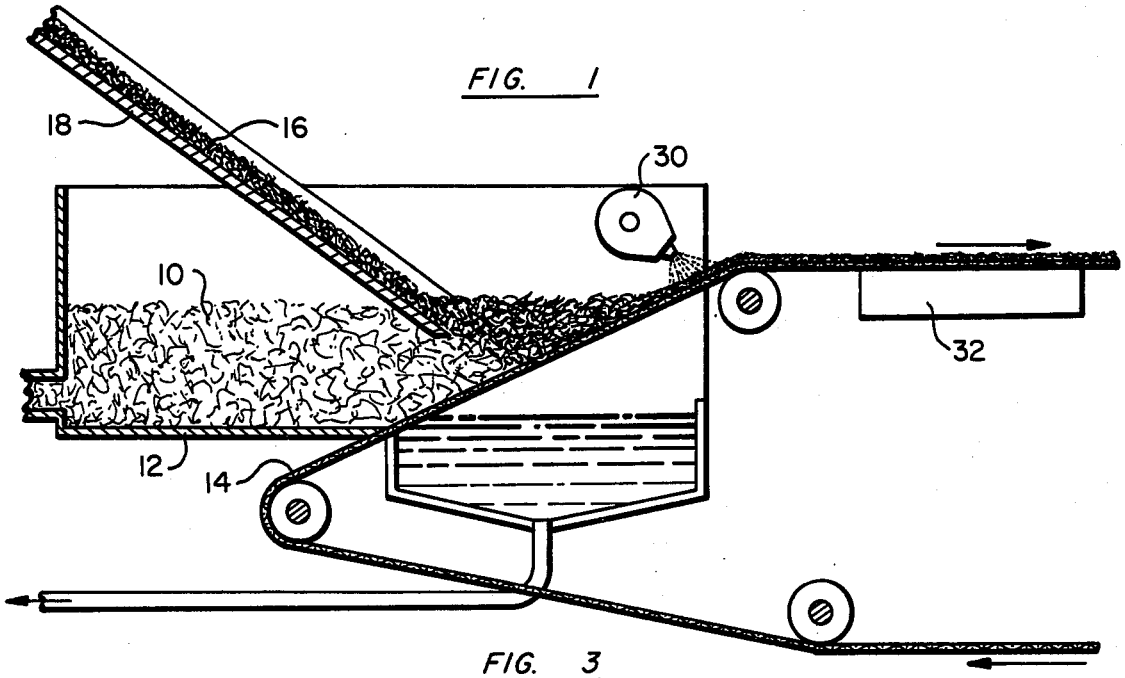
FIG. 1 is a schematic view of the wet end of a paper-making machine depicting one way of operating the process of the present invention for producing a multi-phase infusion web material.

As mentioned, the invention is primarily concerned with multi-phase sheet material since it is directed toward the disruption of only one phase of the multi-phase material, namely, the heat seal phase. Additionally, the invention is primarily concerned with multi-phase water laid material produced in accordance with the conventional paper-making techniques. In this connection numerous different techniques have been employed herefore to make the multi-phase fibrous webs. Typical of those found most useful in the production of infusion web materials is the dual headbox technique described in U.S. Pat. No. 2,414,833. In accordance with that process and as illustrated in FIG. 1, a suspension of non-heat seal fibers 10 flow through a primary headbox 12 and continuously deposit as a base phase on an inclined wire screen 14. The heat seal material 16 is introduced into the primary headbox at a location immediately after or at the point of deposition of the non-heat seal fibers on the inclined wire. This may be carried out by means of an inclined trough 18, as shown, or by a secondary headbox in such a manner that the heat seal particles comingle slightly with the non-heat seal paper-making fibers flowing through the primary headbox 12. In this way, the non-thermoplastic fibers 10 have a chance to provide a base mat or non-heat seal phase, 20, best shown in FIG. 3, prior to the deposition of the heat seal phase, 22. As is appreciated the latter is secured to the base phase by an interface formed by the intermingling of the particles within the aqueous suspensions. Typically, sheets produced in this manner have non-heat seal fibrous covering the entire surface area of the sheet material on the surface in contact with the inclined fiber collecting screen 14 while the top of the sheet material has some non-heat seal fibers and some heat seal fibers with the latter greatly predominating. In this way there is not a clear line of demarcation between the two phases of the multi-phase sheet material; yet there is a predominance of heat seal thermoplastic material on the top surface or top phase 22 of the multi-phase sheet. The center or interface boundary, of course, is composed of a mixture of the two different types of fibers.

Although the technique or process described in the aforementioned U.S. Pat. No. 2,414,833 is preferably followed, the heat seal material used in preparing the heat seal phase of the sheet material is different. It is comprised of synthetic pulp fibrid-like particles. In view of the improved characteristics of such materials, including their high specific surface area, water insensitivity, low density, and smaller particle size, substantially improved seal strength characteristics under end use conditions can be achieved. These synthetic pulps are typically synthetic thermoplastic materials, such as polyolefins, having a structure more closely resembling wood pulp than synthetic fibers. That is, they contain a micro-fibrillar structure comprised of micro-fibrils exhibiting a high surface area as contrasted with the smooth, rod-like fibers of conventional synthetic man-made organic fibers. The synthetic thermoplastic pulp-like material can be dispersed to achieve excellent random distribution throughout the aqueous dispersing media in a paper-making operation and, consequently, can achieve excellent random distribution within the resultant sheet product. The pulps found particularly advantageous in the manufacture of infusion sheet materials are those made of the high density polyolefins of high molecular weight and low melt index.

The fibrils can be formed under high shear conditions in an apparatus such as a disc refiner or can be formed directly from their monomeric materials. Patents of interest with respect to the formation of fibrils are the following: U.S. Pat. Nos. 3,997,648, 4,007,247 and 4,010,229. As a result of these processes, the resultant dispersions are comprised of fiber-like particles having a typical size and shape comparable to the size and shape of natural cellulosic fibers and are commonly referred to as "synthetic pulp". The particles exhibit an irregular surface configuration, have a surface area in excess of one square meter per gram, and may have surface areas of even 100 square meters per gram. The fiber-like particles exhibit a morphology or structure that comprises fibrils which in turn are made up of micro-fibrils, all mechanically inter-entangled in random bundles generally having a width in the range of 1 to 20 microns. In general, the pulp-like fibers of polyolefins such as polyethylene, polypropylene, and mixtures thereof have a fiber length well suited to the paper-making technique, e.g., in the range of 0.4 to 2.5 millimeters with an overall average length of about 1 to 1.5 millimeters. Typical examples of these materials are the polyolefins sold by Crown Zellerbach Corporation under the designation "FYBREL", by Solvay and Cie/Hercules under the designation "LEXTAR" and by Montedison, S.P.A. and others.

Since the pure polyolefin particles are hydrophobic and have a surface tension that does not permit water wettability, the material obtained commercially is frequently treated to improve both wettability and dispersibility in aqueous suspensions. The amount of wetting agent added, however, is relatively small, and generally is less than 5 percent by weight, e.g., about 3 percent by weight and less. The chemically inert polyolefins are thermoplastic materials that become soft with increasing temperature; yet exhibit a true melting point due to their crystalinity. Thus, synthetic pulps of polyethylene exhibit a melting point in the range of 135° C. to 150° C. depending on the composition and surface treatment of the material.

Typically, the fiber composition of the heat seal phase is such that it contains cellulosic paper-making fibers in addition to the heat seal fibers. In this connection, it has been found that for optimum results it is preferred that the heat seal component constitute approximately 70 to 75 percent of the fiber composition within the heat seal fiber slurry. As will be appreciated, variations in the amount of heat seal material will depend on the specific material utilized as well as the source of that material. However a sufficient amount of heat seal particles must be employed to provide satisfactory heat seal conditions in the end product. Consequently, it is preferred that about 60 to 80 percent of the fibers in the heat seal fiber suspension be of a thermoplastic heat seal type in order to provide the necessary characteristics.

It should be noted that the preferred heat seal polymers are those which have already received approval for use in food and beverage applications. Consequently, the synthetic pulp made from polyolefins and vinyon are the preferred materials while other materials may be used for different end use applications. As will be appreciated, the remaining fibers may be of a wide variety depending upon the end use of the fibrous web material. However, for infusion packages having application in the food and beverage field, it is preferable to employ approved natural or man-made fibers and preferably cellulosic natural fibers, for example, fibers of bleached or unbleached kraft, manila hemp or jute, abaca and other wood fibers. A variety of infuser web materials may be made from these fibers and utilized in accordance with the present invention. However, for ease of understanding and clarity of description, the invention is being described in its application to porous infusion web materials for use in the manufacture of tea bags and the like.

As mentioned, the present invention involves opening or enhancing the water permeability of the heat seal phase of a multi-phase sheet material. This can be achieved by altering, disrupting or displacing the heat seal fibers within the heat seal phase prior to the conventional heat drying operation. Although this can be accomplished in numerous different ways, such as by the entrapment and melting of ice particles, or by the use of decomposable particles, air bubbles and the like, it is preferred in accordance with the present invention to achieve the disruptive relocation within the heat seal phase by the use of a light water spray or mist directed onto the heat seal phase, preferably as the initially formed fibrous web material leaves the headbox of a paper-making machine. As is known to those skilled in the paper-making art, the fibrous web material leaving the headbox consists predominantly of dispersing medium with the fibers constituting only a minor portion, that is, less than 20 percent by weight, and typically less than 15 percent of the web material at this stage in its formation. In other words, the fiber consistency has changed from a level of about 0.01–0.05 percent by weight within the headbox to a fiber consistency of about from 1 to 2 percent by weight to 8 to 12 percent by weight on the web forming wire. At this stage, the newly formed fibrous web material is highly succeptible to fiber re-arrangement without adversely affecting the fiber to fiber bonding within the resultant fibrous product. Accordingly, by directing low impact mist-like spray droplets onto the sheet material immediately after it is formed the mist droplets act as if they are falling into a viscous liquid and do not penetrate deeply into the web, disrupting only the heat seal layer and leaving undisturbed the fibers of the base web material.

Preferably, the spray head generating the mist, such as a spray nozzle 30 is located adjacent the lip of the heat seal tray or headbox and the spray is angled slightly away from the vertical toward the wire 14 so that any large water droplets falling from the nozzle will fall harmlessly into the undeposited fiber dispersion within the headbox rather than on the partially dewatered fibrous web material. By positioning the mist spray head at this location, the mist water droplets impact on the partially dewatered fibrous web material between its final formation point upon emergence from the headbox and the suction slot 32 of the paper-making machine where the formed but partially dewatered fibrous web material is subject to a vacuum designed to significantly reduce the water content of the web and facilitate removal of the web from the web forming wire.

Since large water droplets will have the effect of not only removing the heat seal fibers but also a substantial portion of the base phase thereby causing an unsightly disruption in the web, it is preferred that the spray nozzle be selected and that the water pressure be controlled so as to produce a large array of small droplets. The spray can by synchronized with the speed of the paper-making machine so that the very small water drops of a mist consistency having a low impact will impinge on the web at a controlled rate. By suitable choice of the nozzle, the impact force of the water droplets are controlled to produce a disruptive effect on the fibrous web material which affects only the upper portion or heat seal phase of the fibrous web material, leaving the lower or support phase substantially unaffected.

In the preferred embodiment, it has been found that a low impact spray nozzle provides the desired mist-like spray conditions. The low impact type of spray helps to avoid disturbing the base web fibers of the multi-phase sheet material. Multiple spray heads are preferably used and are spaced transversely across the headbox of the paper-making machine. High performance, low output, finely atomizing spray heads operate effectively with minimum water pressure such as mill supply water at 40–45 psi, to provide the preferred spray design such that the mist-like atomized spray impinges on the newly formed web material. In a typical arrangement the nozzles are located approximately six inches apart across the width of the headbox and are spaced from the web forming wide by a distance of about eighteen inches.

A spray head that has been found particularly effective is the hollow cone type designated "MB-1" and sold by Buffalo Forge Company of New York. When operated at a low water pressure of about 40 psi, the $\frac{1}{8}$ inch orifice diameter nozzle provides a spray cone angle of about 45 to 50 degrees and a throughput in the range of approximately 0.2–1.0 liter per minute of water through each spray head. Due to the low water pressure conditions and the highly atomized droplets formed by the hollow cone spray head, the resultant water droplets impinging on the heat seal layer of the newly formed heat seal phase are of a fine or minute droplet size. The actual size of the droplets are difficult to measure but based on the sizes of the craters formed by the drops it is believed they generally fall within the range of about 50–5000 microns in diameter, with the preferred droplet size being approximately 200–2000 microns.

Figure 3:
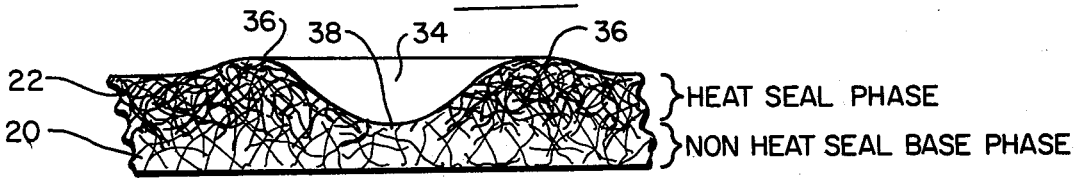
FIG. 3 is a further enlarged sectional view of the web material of FIG. 2 taken along the line 3—3 of FIG. 2.
Figure 2:
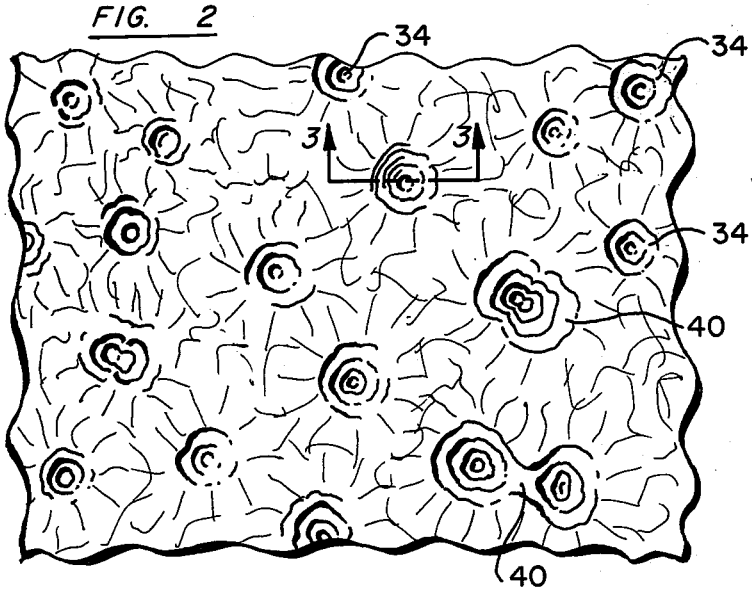
FIG. 2 is an illustration of a planar view of the fibrous web material of the present invention depicting the craters formed within the heat seal phase, the view being substantially enlarged for purposes of illustration.

Due to the high water content of the fibrous web material prior to reaching the suction box 32, the water droplets will tend to displace the fibers, pushing them to the outer edge of the drop and forming small shallow craters in the sheet material, as shown at 34 in FIGS. 2 and 3. The dislodged and displaced fibers within the heat seal phase are pushed to the periphery of the craters by the droplets, as shown at 36 of FIG. 3, leaving an area substantially free of heat seal fibers within the central portion 38 of each crater. Although this results in a sheet material initially having a mottled effect, the small size of the craters i.e., 0.2–2 mm, and the subsequent heat drying operation avoid any unsightly appearance in the resultant web material. In this connection, heat seal tea bag paper is conventionally given a heat treatment during its manufacture to dry and partially adhere the heat sealable fibers within the upper phase to the base web fibers in order to provide the desired integrated web structure. During this heat treatment, synthetic pulp fibers become transparent and the slightly mottled effect resulting from the mist spray becomes almost entirely unobservable. However, if the mist spray is of such a force and size so as to also disrupt the base fiber layer, then the disruption thus produced will be discernable even after the heat drying of the synthetic pulp fibers within the heat seal phase.

As will be appreciated, the craters formed by the water droplets will be present in a random array on the surface of the heat seal material. The size and concentration of the craters will vary substantially depending on the type of spray head and the impact force with which the water droplets strike the web material. Generally, it is preferred that the water droplets create a sufficiently large number of small discrete craters so that the craters occupy up to but less than about 75 percent of the total exposed surface area of the material. In this connection, it is important to assure that a sufficient distribution of heat seal fibers remains so as to provide the necessary heat sealing function. Typically, the craters are present throughout the entire planar extent of the heat seal phase at a concentration of at least about 40 per square centimeter of surface area, and occupy a minimum of about 10 percent of the total exposed surface area of the heat seal phase. An average crater density or concentration is about 60 to 80 craters per square centimeter occupying about 40–55 percent of the total exposed surface area. The craters formed by the impact of the spray drops have a shallow depth and, as indicated, a relatively random pattern that may vary depending on the particular shower head used to form the mist-like spray. Consequently, two adjacent craters may partially overlap as illustrated at 40 in FIG. 2. Additionally, the linear speed of the web forming wire will have an effect on the shape of the crater although the primary effect of machine speed is on the concentration and number of craters per unit of area of the sheet material. In this connection a web formed at 75 fpm linear speed will be impacted by about 7–30 ml of spray per square foot of web to provide the desired crater concentration.

The craters will vary in size and in configuration although most will be circular and typical of the configuration formed as a result of the spray droplets impinging on the readily displacable fibers in the heat seal phase of the sheet material. Typically, the craters will exhibit an average planar area of at least about $1\times10^{-3}$ square centimeters while the individual craters will vary in surface area from about $3\times10^{-1}$ to $3\times10^{-4}$ square centimeters. Although the small size of the craters prevents accurate measurements, the craters naturally vary in size with the size of the droplets. Typically the average planar area of each crater falls within the range of 1 to $9\times10^{-3}$ square centimeters. The diameter of the resultant craters typically falls within the range of 0.04 to 0.2 centimeters, with the average crater diameter being about 0.07 centimeters.

Not only may the production rate alter the size, concentration, and population of the resultant craters, but also the particular shower head can permit substantial variation in the size and pattern of the water droplets used to form the craters since those nozzles can be fitted with interchangeable shower discs. As indicated, however, the primary object of the spray is not simply to create a crater-like impression in the web, but rather to displace some of the fibers in the heat seal phase to provide an area of improved receptivity to water permeability and therefore improved infusion characteristics.

As mentioned hereinbefore, the water permeability of the heat seal web can be enhanced further by the utilization of chemical treatments. In particular, it has been found that the heat seal hydrophobic layer can be treated with surface active agents or surfactant systems to improve the wettability and water permeability of the heat seal phase, even after that phase has been opened by the crater forming technique described hereinbefore. The treatment with the chemical surfactant is not such as to produce a chemical reaction but rather is more in the nature of an alteration in the surface characteristics of the fibrous web material, particularly the wetting characteristics. It is believed that the surface active agent or surfactant will affect the surface tension so as to alter the contact angle between the infusing liquids and the synthetic pulp particles. The contact angle is the angle between a surface and the tangent to a drop of water which has been applied to the surface at its point of contact with the surface. The theory of contact angles and their measurements are well known to those skilled in the art.

The surface active agents can be conveniently classified as anionic, cationic, nonionic and amphoteric. The materials are characterized structurally by an elongated non-polar portion having little affinity for water or water soluble systems and a short polar portion possessing high affinity for water and water soluble systems. The polar portion is hydrophilic and the non-polar portion is lipophilic (hydrophobic). Although different surfactants may be used for different applications, it has been found that nonionic materials having an appropriate hydrophile/lipophile balance (HLB) are preferred for food and beverage uses such as tea bag and similar infusion materials. The most consistent feature of the effective surfactants is that they are nonionic, usually containing a polyoxyethylene group. The nonionic surface active agents do not dissociate in water but nevertheless are characterized by a relatively polar portion and non-polar portion and are the only class of surfactants that can be assigned an HLB number. Materials having HLB numbers from about 10 to 28 appear to work well. However, even among otherwise acceptable surfactants it is necessary that the material meet FDA approval and be free of adverse taste effects. Many surfactants give a strong mouth feel and leave a foamy, plastic or bitter aftertaste. As mentioned, the preferred surfactants are those that contain polyoxyethylene groups and among these, materials such as the polyoxyethylene (20) sorbitan monostearate (HLB-14.9) sold under the trademark "Tween-60" by ICI America have given best results particularly in the taste test. Blends of two or more agents also may be used.

Typically, the surfactant is added to the sheet material after formation and conveniently can be applied as a dilute solution (1 percent) of the agent. Such an operation will generally result in the addition of 0.1–0.6 percent of the surface active agent based on the dry fiber weight with 0.3 percent being preferred. It may be applied at various stages in the paper-making process, even while it is still on the forming wire, or later by size press or at the wind up reels. Application at the wet end can result in very poor retention of the agent and/or lowering of the internal bonding strength or tensile properties of the finished paper so that, preferably, the material is applied to the formed and dried web. This can be achieved by spraying or size pressing the web with a large amount of the solution containing a low concentration of surface active agent followed by subsequent drying. This leads to a uniform distribution of the surface active agent through the web. Of course other well known alternative methods of applying the material prior to the take up reel using a small amount of high concentration solution or by calendar stack application may be used. The preferred method is to spray the dry sheet material with a one percent solution of the surface active agent between two drying sections of the paper-making machine using a very coarse spray to obtain high absorption efficiency. The surface active agent employed to produce the desired effect is limited not only to those which have FDA approval for the particular end use and have minimal effect on taste, but also to those that will show maximum effect at a minimum application level.

As mentioned, it has been found that the use of synthetic pulps, while providing improved seal strength characteristics, are deficient with respect to wettability and infusion properties. The expression "wettability" refers to the speed and uniformity of water abdsorption by the paper under end use conditions. Thus upon immersion of the material non-wetted or poorly wetted areas of the sheet are easily observed as opaque white areas while the thoroughly wetted areas immediately become transparent. A poorly wettable paper, therefore, produces an aesthetically displeasing appearance and can be readily noted while a paper exhibiting good wettability characteristics will rapidly absorb water and exhibit a uniform appearance. "Infusion" refers to the rate at which water can pass into the tea bag and tea liquor can pass out of the tea bag as well as the degree of extraction which is able to take place within a specified time. This is usually reported in terms of "first color" and "percent transmittance", respectively. When testing for first color a tea bag made from the material to be tested is carefully placed in quiet distilled water after the water has been brought to a boil. Using a stopwatch the time is recorded at which the first amber stream appears at the bottom of the sample. A first color time of about 5–6 seconds is considered indicative of good infusion characteristics. The percent transmittance test is conducted by measuring the transmittance of the brew after a 60 second steep time using a Markson Colorimeter Model T-600 at a wavelength of 530 mμ and using a 1 cm. cell. A target value for good infusion is in the mid-sixty percentile range with transmittance decreasing as infusion improves.

The following samples are given in order that the effectiveness of the present invention may be more fully understood. These examples are set forth for the purpose of illustration only and are not intended in any way to limit the practice of the invention. All parts are given by weight.

EXAMPLE I

This example shows the improved infusion characteristics obtained by using the process of the present invention.

A base phase fiber dispersion was prepared from about 75 percent hemp fibers and 25 percent wood fibers and a separate heat seal fiber dispersion was prepared using a fiber formulation comprising 75 percent polyethylene synthetic pulp FYBREL ® E-400 and 25 percent kraft wood pulp. Using these dispersions a two phase heat seal sheet material was formed on a paper-making machine operated at a linear speed of about 75 feet per minute to provide a web material having a basis weight of about 16.5 grams per square meter. As the sheet emerged from the headbox, it was treated with a fine mist water spray directed toward the wet fibrous web at a location of about 1 inch from the stock dam. The spray nozzle was of the hollow cone type, Model MB-1 with a ⅛ inch orifice located about 18 inches from the web at a pressure of about 40 psi. The sheet material thus produced was dried on steam heated can dryers and was subject to an airless spray of a 0.16 percent solution of polyoxyethylene (20) sorbitan monostearate surfactant (Tween-60). The resultant material was designated Sample 1-A.

For comparison purposes, a second web material was produced in the identical manner as Sample 1-A from the same fiber dispersions except that the web was not subject to the mist spray and did not receive the surfactant treatment. The second material was designated 1-B.

These web materials were tested for infusion characteristics and wettability and the results were compared with the properties of a commercial grade of heat seal tea bag paper designated Sample 1-C. The results are reported in Table 1. The first color and percent transmittance data is the average of four separate tests conducted in the manner set forth hereinbefore.

TABLE I

| Sample No. | First Color (sec) | Transmittance (%) | Wettability |
|---|---|---|---|
| 1-A | 6.0 | 67.3 | good |
| 1-B | 7.8 | 73.0 | poor |
| 1-C (control) | 5.8 | 65.8 | good |

EXAMPLE II

The procedure of Example I was repeated except that a change was made in the type of synthetic pulp used in the heat seal layer. The FYBREL ® was replaced by a synthetic pulp called "Pulpex" sold by Solvay and Cie. Sample 2-A is the material treated with the mist spray and surfactant while Sample 2-B is the identical material without the mist or surfactant treatments. Once again, the average of four tests are reported in the table.

TABLE II

| Sample No. | First Color (sec) | Transmittance (%) | Wettability |
|---|---|---|---|
| 2-A | 8.0 | 70.3 | good |
| 2-B | 9.0 | 77.8 | poor |

As can be seen the treatment according to the present invention provided substantial improvement in the infusion and wettability properties.

EXAMPLE III

This example illustrates the effect of the mist spray treatment on the infusion characteristics of a two phase heat seal material with and without the surfactant treatment.

In this example, the procedure of Example 1 was repeated. Sample 3-A was treated by both the mist spray and surfactant while Sample 3-B is identical except that the surfactant treatment was omitted. Sample 3-C was prepared from the same fiber furnish but received no mist spray and no surfactant. Sample 3-D is a control sheet of a typical commercial two phase heat seal web material.

TABLE III

| Sample No. | First Color (sec) | Transmittance (%) | Wettability |
|---|---|---|---|
| 3-A | 5.8 | 65.0 | good |
| 3-B | 5.5 | 66.7 | poor |
| 3-C | 7.5 | 69.2 | poor |
| 3-D (control) | 5.5 | 64.7 | good |

As will be apparent to persons skilled in the art, various modifications, adaptations and variations of the foregoing specific disclosure can be made without departing from the teachings of the present invention.

We claim:

1. In a wet papermaking process for preparing a light weight multiphase heatsealable fibrous web material having excellent infusion characteristics comprising the steps of forming a dilute dispersion of heatsealable fibers in an aqueous dispersing medium; providing a fibrous substrate phase of non-heatsealing character; depositing said dispersion on said substrate phase while simultaneously removing a sufficient portion of said dispersing medium to form a partially dewatered heatsealable fiber phase superimposed on said substrate phase, said partially dewatered heatsealable phase having a fiber consistency of at least about one percent by weight with the remainder being substantially dispersing medium; and subsequently drying the resultant multi-phase web material to remove the dispersing medium and firmly secure the superimposed heatsealable phase to said substrate phase, the improvement wherein the heatsealable fibers are highly fibrillated synthetic thermoplastic particles and the process includes the step of disruptively dislodging and displacing portions of the heatseal particle in the partially dewatered heatseal fiber phase while superimposed on the fibrous substrate and prior to removing a major portion of the dispersing medium initially retained within said superimposed phase to provide a random array of discrete areas of reduced heatseal particle content and enhanced infusion in said multi-phase web material, the enhanced infusion areas being present throughout said heatseal phase at a concentration sufficient to occupy about 10–75 percent of the planar surface area of said heatseal fiber phase having an average diameter per area of up to 5 mm and an average planar area of at least $1\times10^{-3}cm^2$ and being substantially invisible in the dried web material, said substrate phase being substantially unaffected by the displacement of portions of the heatseal phase and being itself substantially unmodified.

2. The process of claim 1 wherein said infusion areas of reduced heatseal particle content have an average concentration of at least about 40 per sq. cm.

3. The process of claim 1 wherein the step of dislodging and displacing the heatseal phase includes treating the partially dewatered phase with a low impact mist-like liquid spray to form a random array of a large number of small high infusion areas of reduced thermoplastic particle content in the form of discrete shallow craters.

4. The process of claim 3 wherein the low impact liquid spray to dislodge and displace the heatseal particles and form the random array of a large number of small, high infusion areas of reduced heatseal particle content in the form of discrete shallow craters having an average planar area per crater of about $3\times10^{-4}$ to $3\times10^{-1}$ sq. cm. and an average diameter in the range of 0.05–5 mm., the process including the step of treating the heatseal phase with a surfactant.

5. The process of claim 4 wherein the finely atomized spray is formed using a high performance hollow cone type spray head and the craters occupy about 40–55 percent of the total surface area of the heatseal phase and have an average diameter of about 0.7 mm.

6. The process of claim 1 wherein the thermoplastic particles are a synthetic pulp comprised of high density polyolefin having a molecular weight greater than 40,000 and a melt index less than 0.1, the particles being of high specific surface area, low density and small particle size; the discrete areas being shallow craters having an average planar diameter in the range of 0.2–2 mm. and an average concentration of at least about 40 per sq. cm.

7. The process of claim 6 wherein the average concentration of craters is about 60–80 per sq. cm.

8. In a lightweight fibrous multi-phase heatsealable infusion web material comprising a non-heatseal fiber phase, a coextensive heatseal fiber phase superimposed thereon and an interface of intermixed non-heatseal and heatseal fibers secured between said phases, the improvement wherein said heatseal fiber phase and interface is provided with a large number of small, discrete physically modified high infusion areas of substantially reduced heatseal fiber content in the form of shallow craters that are substantially invisible in the dry web material, said high infusion areas occupying about 10–75 percent of the surface area of said heat-seal fiber phase having an average diameter per area up to 5 mm and an average planar area of at least $1\times10^{-3}cm^2$, said underlying nonheatseal fiber phase being substantially free of associated areas of reduced fiber content.

9. The web material of claim 8 wherein the discrete shallow craters have an average planar area per crater in the range of about $3\times10^{-4}$ to $3\times10^{-1}$ sq. cm. and an average concentration of at least about 40 per sq. cm.

10. The web material of claim 8 wherein the heatseal fibers comprise synthetic pulp and the small shallow craters have an average diameter in the range of 0.05–5 mm.

11. The web material of claim 10 wherein the periphery of each crater has a higher synthetic pulp content than the non-crated planar portions of the heatseal phase, some of said craters being essentially free of heatseal fibers at their base so as to expose portions of said underlying nonheatseal phase.

12. The web material of claim 8 wherein the discrete shallow craters occupy 40–55 percent of the total surface area, the craters having an average planar area per crater in the range of about $1\times10^{-3}$ to $9\times10^{-3}$ sq. cm. at an average concentration of at least about 40 per sq. cm., said craters having an average diameter in the range of 0.2–2 mm.

13. The web material of claim 8 wherein the heatseal fibers comprise fibrillated thermoplastic synthetic pulp of high specific surface area and low density.

14. The web material of claim 13 wherein the synthetic pulp is comprises of high density polyolefin having a molecular weight greater than 40,000 and a melt index less than 0.1.

15. The web material of claim 8 containing a sufficient amount of surfactant to provide substantially uniform wettability within the heatseal phase of the web material.

16. The web material of claim 8 containing at least about 0.1 percent by weight of a nonionic surfactant containing a polyoxyethylene group, said surfactant being FDA approved for food contact applications, having a minimal effect on taste and providing substantially uniform wettability of the dried web material.

17. The web material of claim 16 wherein the surfactant is polyoxyethylene (20) sorbitan monostearate.

* * * * *